US005598830A

United States Patent [19]

Creel, Sr.

[11] Patent Number: 5,598,830

[45] Date of Patent: Feb. 4, 1997

[54] HAND BOW PRESSURE RELEASE AID

[76] Inventor: F. Wayne Creel, Sr., 605 W. Howard Ave., Biloxi, Miss. 39530

[21] Appl. No.: 280,729

[22] Filed: Jul. 26, 1994

[51] Int. Cl.[6] ..... F41B 5/14

[52] U.S. Cl. ..... 124/86

[58] Field of Search ..... 124/23.1, 24.1, 124/25.6, 35.2, 86, 88, 90, 91

[56] References Cited

U.S. PATENT DOCUMENTS

| | | | |
|---|---|---|---|
| 1,210,332 | 12/1916 | Kvistad . | |
| 2,664,078 | 12/1953 | Irwin . | |
| 2,815,016 | 12/1957 | Kellogg | 124/35.2 |
| 3,895,621 | 7/1975 | Kellogg . | |
| 5,000,154 | 3/1991 | Slayton | 124/23.1 |
| 5,002,035 | 3/1991 | Brooks | 124/23.1 |
| 5,065,730 | 11/1991 | Kluver | 124/35.2 |
| 5,092,308 | 3/1992 | Sheffield | 124/35.2 X |
| 5,146,908 | 9/1992 | Larson | 124/88 |
| 5,156,138 | 10/1992 | Grover | 124/35.2 |

*Primary Examiner*—John A. Ricci
*Attorney, Agent, or Firm*—Pravel, Hewitt, Kimball

[57] ABSTRACT

A support for a cocked bow is mounted to the bow handle, and provides a rod for supporting the bow string in a fully cocked position. The device is spring biased to engage the drawn string. A finger operated handle positioned in front of the bow handle, permits smooth controlled movement of the rod away from engagement with the bow string. The rod pivots about a split bearing mounted along a vertical line, effectively preventing vertical motion or vibration of the rod. The mounting of the device directly couples sheer forces form the drawn bow string into the handle, providing a strong mount.

9 Claims, 6 Drawing Sheets

HAND BOW PRESSURE RELEASE AID

BACKGROUND OF THE INVENTION

This Invention pertains to devices for holding a hand archery bow in a fully drawn position, relieving the pressure and strain on the arm, back and shoulder of the archer.

U.S. Pat. No. 5,000,154 to Slayton discloses a bow draw support assembly in which a clevis, attached to a compound archery bow hand grip, supports an extended rod. At the rear end of the rod is a yoke with two notches for supporting a bow string. An internal spring within the clevis biases the rod to an outward position, and a finger-acting lever attached to the rod permits the rod to be swung in line with the bow string when the bow is drawn. The bow string is supported by the notches in the rod. When it is desirable to use the bow, the string is slightly drawn and the internal spring causes the support assembly to swing out of the way of the bow string, permitting the archer to aim and release.

U.S. Pat. No. 5,065,730 to Kluver discloses a fixed prop or support which may be placed to hold a bow string of a compound bow in an extended drawn position, supporting, at one end, the bow string and bracing it against a notch in the front end which engages the bow. An arrow may be placed on the bow string in the usual manner. The bow may be fired by simply pulling back on the bow string; the prop falls to the ground, releasing the bow string for firing.

U.S. Pat. No. 2,664,078 to Irwin discloses a bow string support which includes a handle for drawing the bow string and a nocked arrow into a fully drawn position. The bow string support slides within a channel fastened to the front of the bow and has one or a series of notches so that as the bow string and nocked arrow are drawn back with the bow string support by pulling on the handle 90, the bow string support falls into one or more of the notches, locking the bow string in a properly drawn position. The arrow is gripped by a trigger notch within the bow string support and a finger trigger is provided on the bow string support for releasing the bow string and the arrow. It should be noted that the support does not swing out of the way, but is merely mounted to one side of the bow string and the arrow and remains in position during release.

U.S. Pat. No. 1,210,332 to Kvistad discloses a mechanical lever fastened between the hand grip portion of a bow and sliding upon the bow string for drawing the bow into a fully extended position. The device includes a specialized trigger release and arrows.

U.S. Pat. No. 5,002,035 to Brooks discloses a Bow Pressure Relief String Holder device for a compound archery bow in the form of a first fixed leg mounted above the hand grip portion of the bow, extending to the rear, and a second leg pivotally mounted to the first leg. The joint between the legs is spring-loaded so that the second leg supports the bow string in a cocked position, but, when the bow string is pulled back further, the second leg pivots away, out of the line of the bow string.

U.S. Pat. No. 2,815,016 to Kellogg discloses an attachment for a long bow in the form of two fixed parallel rods attached to the hand grip of the bow and extending to a handle behind the position of the cocked bow. The handle includes a trigger and release mechanism for holding the cocked bow and arrow in position and then releasing the bow and arrow.

U.S. Pat. No. 5,156,138 to Grover discloses, a bow string drawing and Bow Pressure Relief String Holder device in the form of a sliding tube received within a guide on the handle of the bow. A trigger mechanism for holding the bow string is mounted at the rear of the tube as part of a handle mechanism for drawing the tube to an extended position. An internal lock within the draw tube guide on the handle locks the draw tube into a drawn position at one of a number of drawn positions as the tube is drawn backwards. A lever, extending forward of the hand grip section, releases the draw tube lock permitting the draw tube to be pushed to a forward position. In use, the arrow is nocked on the bow string, and the bow string is caught in the trigger mechanism on the rear of the draw bar handle. The draw bar is drawn to a fully taunt position at which point the looking mechanism looks it in the drawn position, holding the bow string and arrow in a drawn, cocked position. The bow string and arrow can be released by activating the trigger on the handle. The bow string is then re-cocked by releasing the draw bar, sliding it forward, re-locking the bow string into the trigger and repeating the process.

U.S. Pat. No. 3,895,621 to Kellogg discloses, as part of a trigger mechanism for holding and releasing a bow string, a sliding or folding tube connected between the handle portion of a bow and the trigger handle. This patent discloses a tube for holding a bow string in a drawn position as part of the claimed invention, which is to a novel trigger mechanism for releasing the bow string.

None of this prior art directly addresses a major problem with such bow attachments. The purpose of such a support is to lessen muscle fatigue in the archer, in order to reduce movement during the crucial aiming period when the game is closest and most easily spooked; yet the disclosed devices all create snapping or vibrating motions at the critical period of release, when such motions are most deleterious.

SUMMARY OF THE INVENTION

The Invention discloses a form of bow string support which is adaptable to a compound bow of current design and which holds the bow in a cocked position. The device is easily released by an archer without sudden motion, in order to allow the bow to be safely fired.

The device comprises an add-on support which may be fastened to the handle of a compound bow and which is adapted to particularly fit at the bow hand grip without interfering with sight brackets or other accessories. The device has a unique pivoting structure, providing support for an adjustable length rod which extends back to a position approximating full cock for a nocked arrow on the bow string. The device is spring loaded so that it is in line with the full draw position of the bow string; when the bow is drawn, by one hand or two, the string naturally falls into a provided support notch on the rod. The bow string is then supported by this support notch; the bow pressure relief string holder device supports the load of the cocked bow, relieving muscular tension upon the archer. A provided handle extends down within the natural position of the fingers of the hand which normally holds the bow. The action of the device is such that this handle may be gently squeezed while still maintaining muscular resistance against the handle of the bow in the normal cocked firing position. This squeeze action smoothly swings the rod away from the bow string as the bow string is pulled back into full tension in preparation for firing. The rod swings a fixed distance out of line with the bow string, away from the archer's face, without vibrating or otherwise interfering with the aim sight or stability of the arrow. The bow string may then be readily released to fire the arrow.

The particular construction of the hinge and bracing for the rod is such that the rod is spring loaded to a bow string supporting position. Further, the device pivots on a bearing having substantial resistance to rotational twisting or vertical motion of the rod. Thus, the rod returns to an optimum cocked position each time, is not displaced vertically, and does not interfere with proper firing or controlled release of the archery bow.

It is thus an object of the Invention to disclose a Bow Pressure Relief String Holder support aid which holds a bow in cocked position, relieving muscular strain on the archer.

It is a further object of the Invention to show a Bow Pressure Relief String Holder support apparatus which has substantial resistance to vertical or rotational movement.

It is a further object of the Invention to disclose a Bow Pressure Relief String Holder support mechanism which is adaptable to a bow without interfering with the mounting of sights and bow arrow adjustment mechanisms.

It is a further object of the Invention to disclose a Bow Pressure Relief String Holder mechanism which can be smoothly released while the archer is holding the bow in a normal fully drawn position, holding the bow string apart from the center of the bow by the extended force of the archer's arm.

It is a further object of the Invention to disclose a Bow Pressure Relief String Holder support mechanism which only requires a normal, natural release motion, in conjunction with the normal support of an extended bow, to release the bow from the cocked position for firing.

It is a further object of the Invention to disclose a Bow Pressure Relief String Holder support mechanism which has a controlled movement, which does not cause the bow to vibrate or twist when the bow string is pulled and then released to shoot, or otherwise give an alerting signal to game animals while hunting.

It is a further object of the Invention to disclose a bow pressure relief aid which can be loaded with both hands to enable the handicapped, disabled, or other persons lacking strength, to shoot a bow compound where the initial pull exceeds the archer's strength, but the "letoff" is sufficiently lower that release is possible.

These and other objects of the Invention may be more clearly seen from the Detailed Description of the Preferred Embodiment which follows.

DETAILED DESCRIPTION OF THE INVENTION

Figure 1:
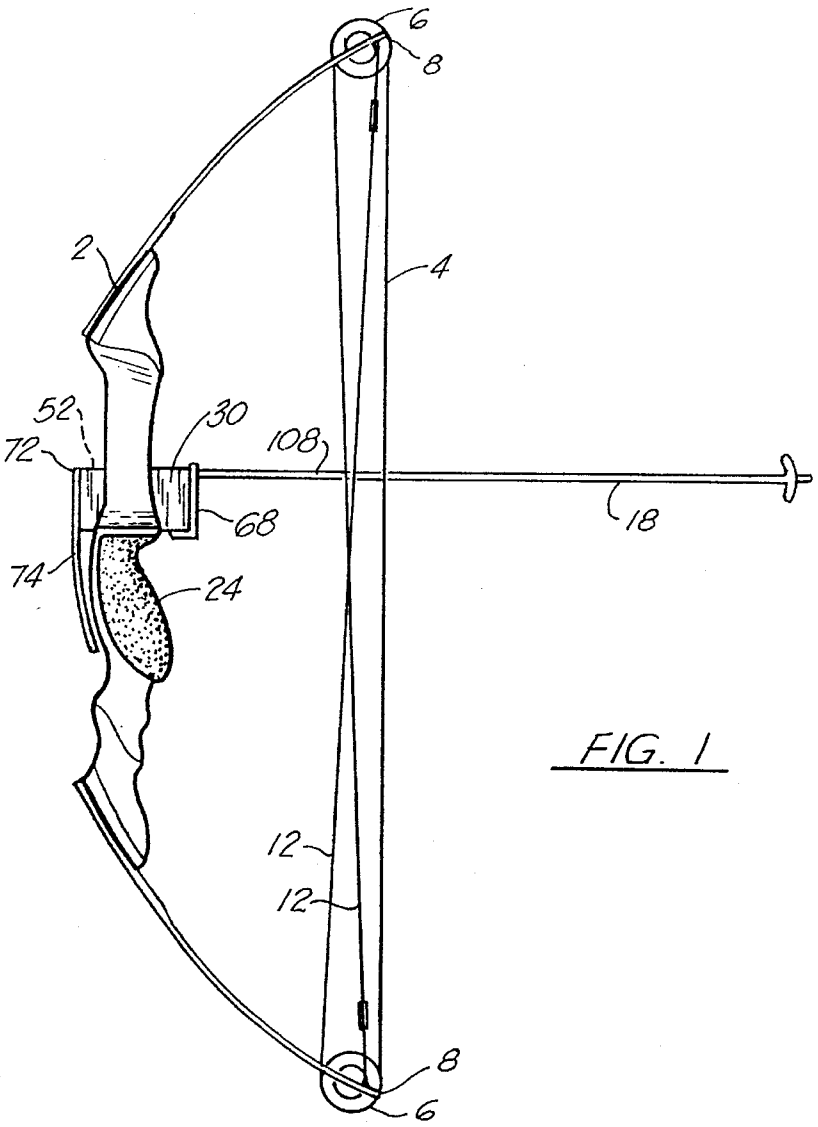
FIG. 1 is a side view, from the arrow rest side, of a compound archery bow with the invention installed.
Figure 2:
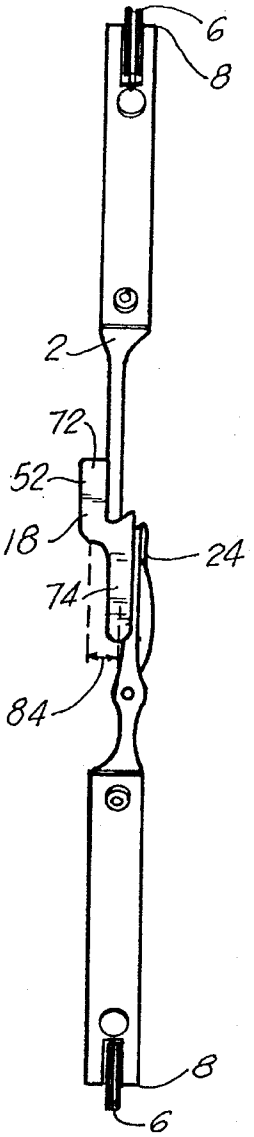
FIG. 2 is a face view, from the front, of a compound archery bow with the invention installed.
Figure 3:
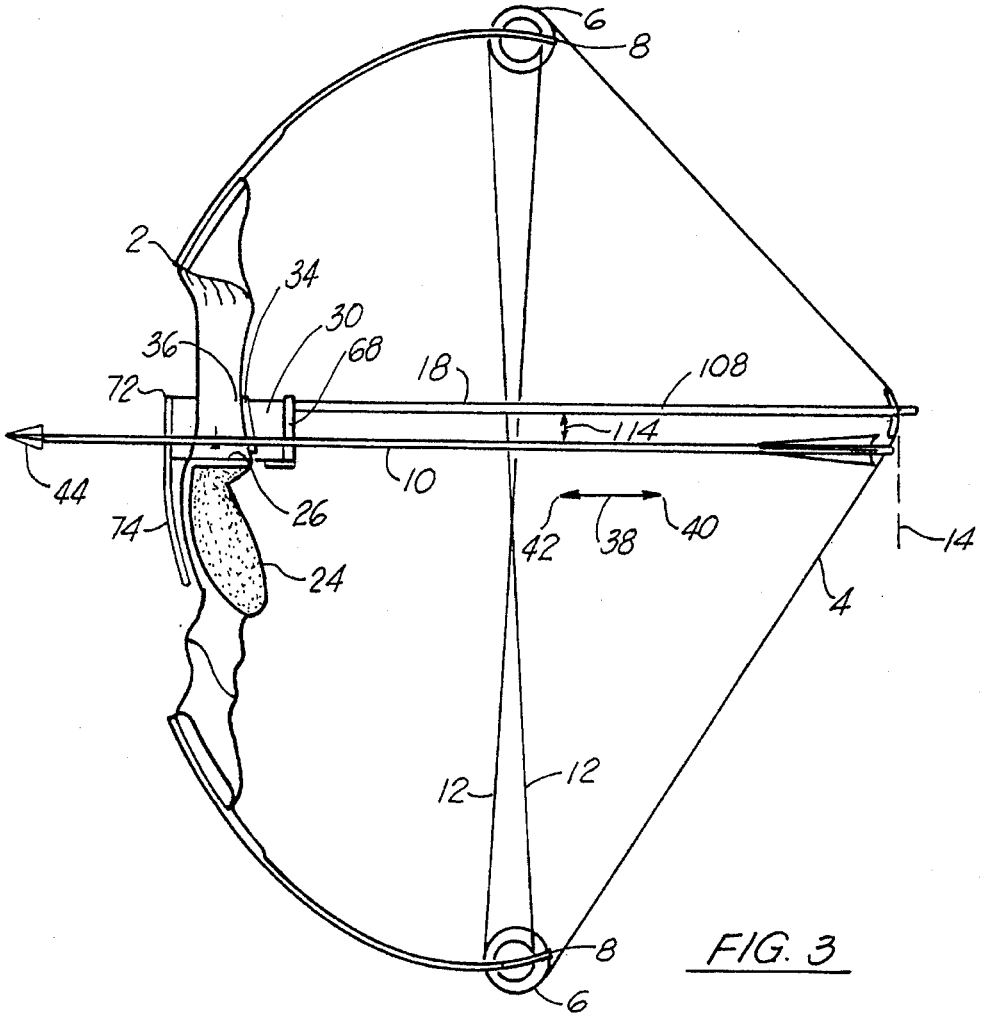
FIG. 3 is a side view of a compound archery bow with the invention installed, the bow fully cocked, with arrow.
Figure 4:
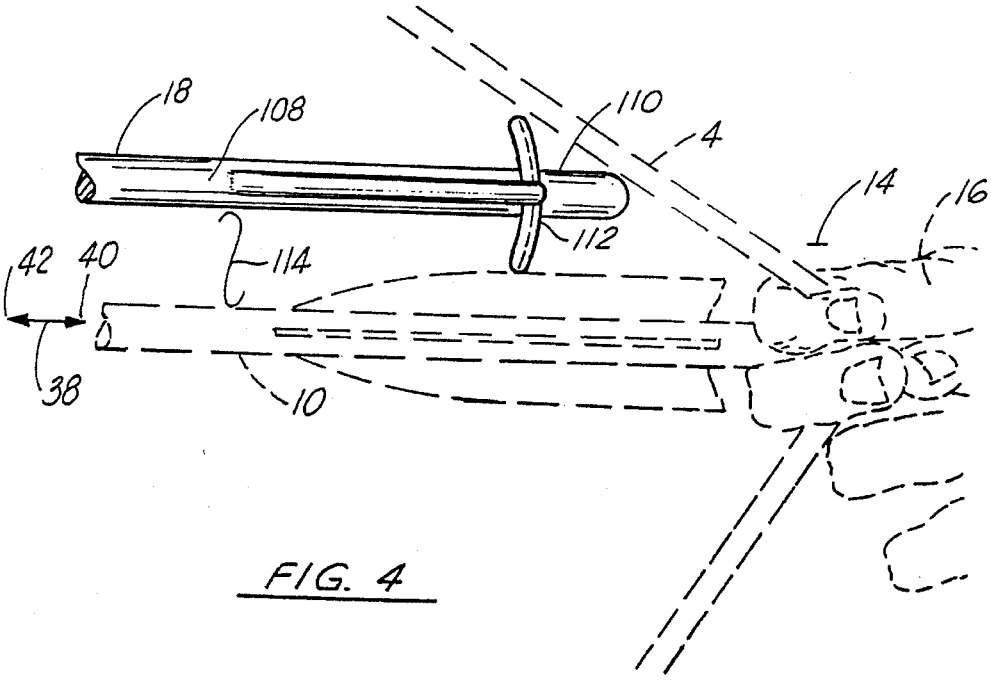
FIG. 4 is a detailed view of the rod end of the invention, upon draw, and before release, of an arrow.
Figure 5:
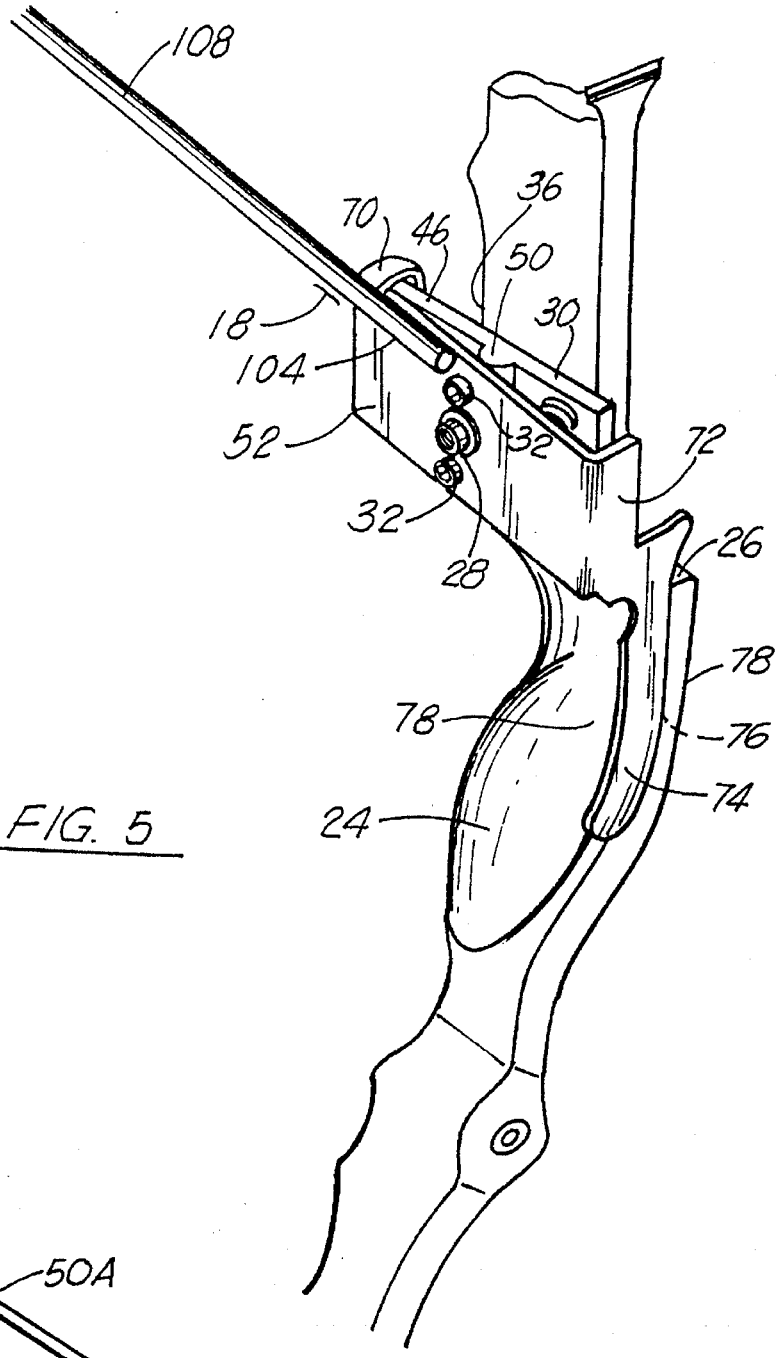
FIG. 5 is a detailed view of the pivot plate and handle of the invention installed to the base support plate.
Figure 6:
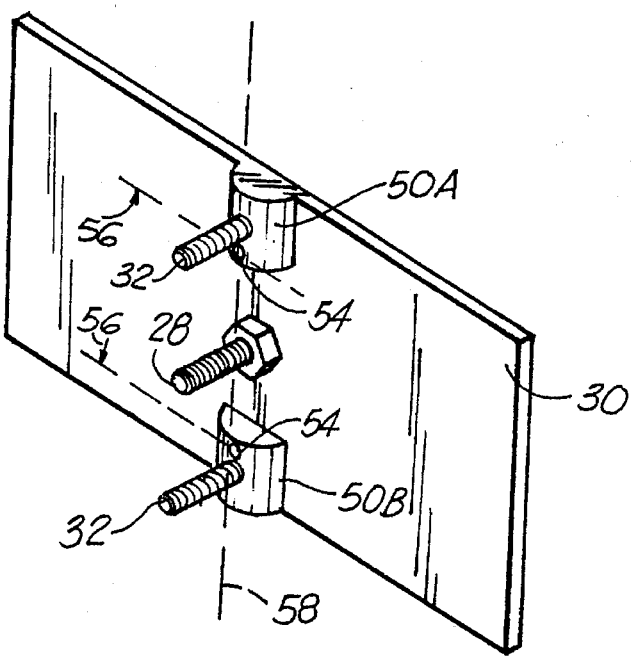
FIG. 6 depicts the base support plate.
Figure 7:
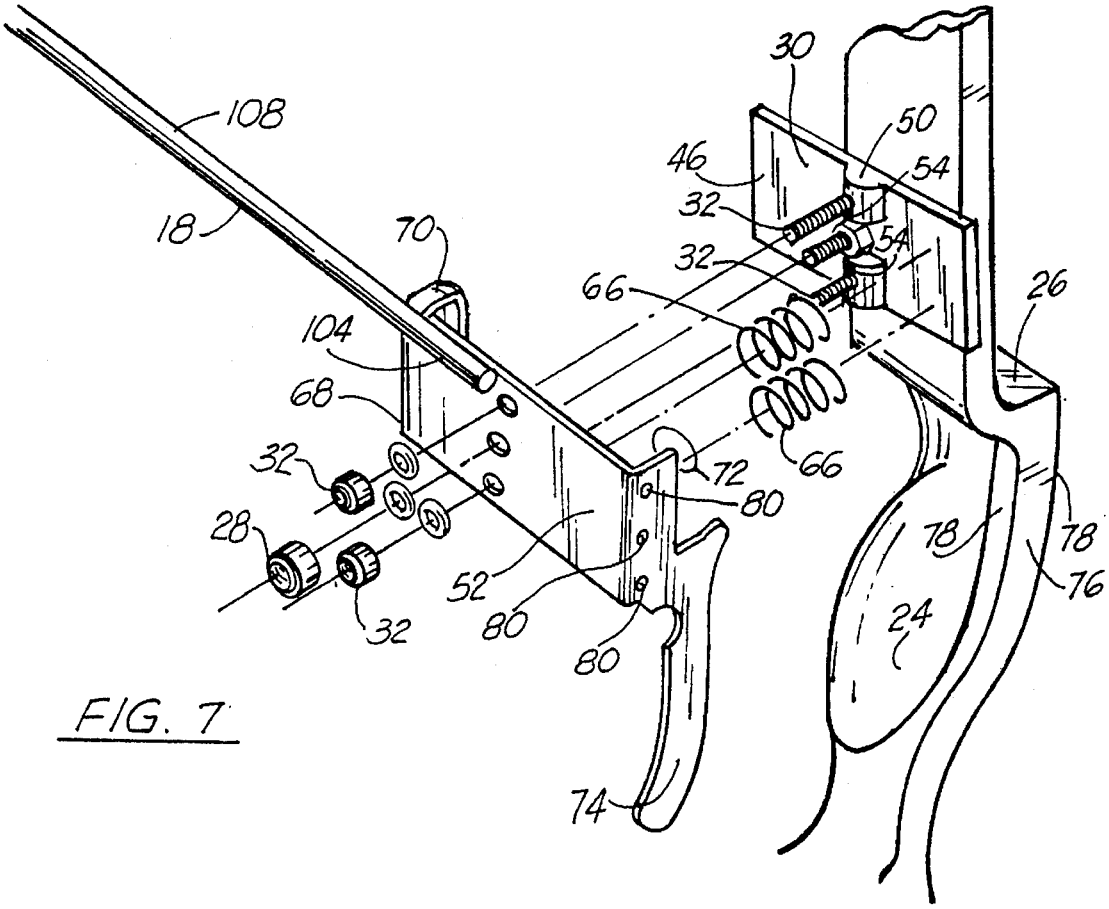
FIG. 7 is an exploded view of the pivot plate and handle of the invention installed to the base support plate.
Figure 9:
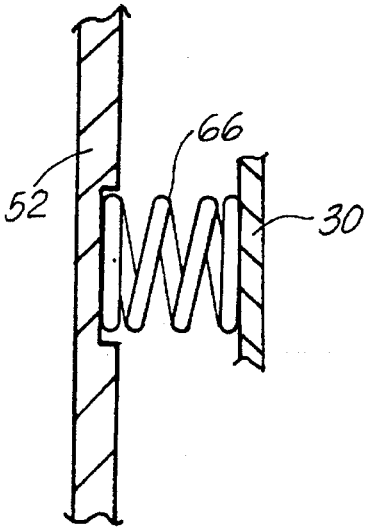
FIG. 9 is a cross section of a bias spring of the invention.
Figure 8:
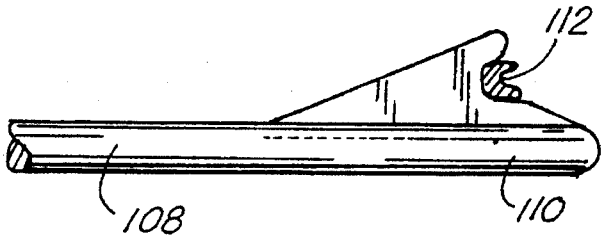
FIG. 8 is a detail of the rod end of the invention.

The Figures show the invention installed on a compound bow 2, which represents the most complex environment for its use. All of the following discussion is generally applicable to any standard form of Archery Bow, and those skilled in Archery will readily see how the invention can adapt to and be installed on such bows. Compound bows 2 are characterized in that the bow string 4 is wound or set through a system of eccentric pulleys 6 at the ends 8 of the bow 2. These pulleys 6 vary the force required to draw the bow string 4 so that draw force is lessened as the bow string 4 is pulled; this is the opposite effect from that expected from drawing a standard bow. This decrease in pull force is called "letoff". The cost of this improved performance is a more complex string and bow arrangement. In particular, there are, in addition to the drawn bow string 4 to which an arrow 10 is nocked, at least two intertwined bow strings 12 extending from the pulleys 6 to opposite ends 8 of the bow. These strings 12, in a plane slightly offset laterally from the line of the arrow 10, must remain free to move, without binding or interference.

Letoff in string draw force serves to lessen the strain of holding the bow at full draw 14 or fully cocked; it also produces a beneficial smooth increase in string force as the bow string 4 is released, providing a controlled increase in arrow acceleration during the firing movement of the bow string 4. As an example of letoff from a typical hunting bow, the pull required for an 85 pound pull bow drops to about 35 pounds to hold the string at full cock 14. Even this reduced force rapidly induces muscle strain in the user.

The motion of drawing a bow is often enough to spook game. Therefore the bow 2 should be drawn before the game is in full view, and the bow should be held motionless during the final moments of aiming as the intended game comes within range. Any untoward motion by the archer during this critical period will spook the game. Yet the act of holding the bow at full draw 14 produces muscle strain in the archer, who is holding the bow by one hand on a fully extended arm, and who is holding the bow string pulled back with the other arm 16. The natural processes of age and fatigue make such activities a considerable strain for the archer; the necessity of remaining motionless during this strain exceeds the capabilities of many archers including those who are unable to hunt due to various physical disabilities.

The invention 18 is a support for a fully drawn bow string 4 which is mounted to the bow 2, and which supports 20 the string 4 in a drawn position 14, yet is easily withdrawn 22 by the archer, without creating such motion or vibration as would spook game.

In understanding the structure of the invention, it is necessary to understand that several critical bow systems are mounted in a bow handle 24 adjacent to the arrow rest 26.

The two most important such items are a bow sight (not shown), which is usually mounted just above the arrow rest 26, offset to the side of the handrest 24, and an arrow rest adjustment mechanism 28. Precision hunting bows have a mechanism 28 for adjusting the tension and positioning force on an arrow held in the arrow rest on the bow handle. This mechanism must be adjustable, and consequently will have an adjustment, typically a screw with a finger adjustment cap 28, which extends through the bow handle 24 at the level of the arrow support 26. More elaborate arrow support devices, for example, "snake teeth", may be mounted at the level of the arrow rest. Any additional bow mechanism must not interfere with the mounts for the bow sight, any arrow support device, or screw 28.

The invention 18 is attached to the handle 24 of a bow 2 by a base support plate 30, which is a plate generally rectangular in aspect, extending alongside the handle 24 of the bow, and held against the side of the handle 24 by two attachment screws and nub 32. The plate 30 may be flat, to fit a flat sided bow 2, or may be rounded or fit to an adaptor for bows with rounded arrow rest cross sections. An opening in the plate 30 permits free passage of the arrow rest adjustment screw 28.

A lip 34 extends across the plate, and engages the rear surface 36 of the bow 2 at the handle 24. Substantially all the force of the bow string 4 as supported by the invention is compressive force along the line 38 of the invention 18, which appears at the support plate 30 as a force in shear against the plate 30; the lip 34 couples this force to the bow 2, so that very little shear force is exerted against the attachment screws 32.

The normal position of an arrow 10 in a cocked bow defines a line of position 38 along the bow from rear 40 to front 42, front 42 being in the direction of the tip 44 of the arrow 10. For this description, vertical is a direction perpendicular to this arrow position, parallel to the line of the bow string 4 when the bow 2 is not cocked.

As the base plate 30 is mounted on the side of the handle 24, it extends to the rear 40 past the rear 36 of the bow handle 24 for a distance, forming a rear projecting stub 46. Along the side of the base plate 30, extending vertically along the plate 30 is a pivot ridge 50. Since the arrow rest adjustment screw 28 passes through this ridge 50, the ridge 50 is normally split into two segments 50A, 50B.

A pivot plate 52 is attached to the base plate 30 by the attachment screws 32. The pivot plate 52 is supported against the pivot ridge 50 by two spaced bearing supports 54, which are spaced vertically along the base support plate 30. In a first embodiment, the bearing supports are two spaced apart ball bearings 54A, partially recessed into the pivot plate 52 and partially recessed into the pivot ridge 50. These bearings 50 are the points of contact of the pivot plate 52 and the support plate 30; the pivot plate 52 rocks or pivots, with respect to the base plate 30, around a vertical axis 58 through these bearings 54. The spacing 56 between the bearings 54 prevents the pivot plate 52 from rocking in any other axis, and from shifting or rotating with respect to the vertical axis 54, or from twisting when string 4 is pulled and the invention 18 is released to shoot. The ball bearings 54A are partially recessed, as all bow string forces, transmitted by the pivot plate 52, are transferred to the base plate 30 through the ball bearings 54A in shear. This force can reach 90 pounds in a heavy hunting bow. In a compound bow where letoff occurs device can be subject to up to 60 pounds of pressure. State of the art bows exceed 90 pounds of pull with 50 to 65% letoff, for a more typical load of 40 to 45 pounds of force.

An alternate bearing 54 is formed by a line pivot bearing 54B on the pivot plate 52, which fits into a mating recess line 60 in the pivot ridge 50. In this structure, which is more resistant to shear forces, it is preferred that the surface 62 of the line bearing 54B or the surface 64 of the recess line 60, or both, be lined with a friction reducing material, such as Teflon, or a lubricated metal or plastic surface layer.

The pivot plate 52 is biased in position by one or more bias springs 66 so that it normally is held parallel to the base plate 30, which is in line with the line 38 of the arrow 10 and bowstring 4. The rear 68 of the pivot plate 52 is folded to form a box end 70, which encloses, but normally does not touch, the rear stub 46 of the base support plate 30. This box 70 forms a safety coupling, retaining the pivot plate 52 against sudden forward or vertical motion in the event of bearing failure under load.

The front 72 of the pivot plate 52 is formed into an offset handle 74. This handle 74 is formed to follow the front shape of the bow handle 24, so that it covers the front 76, but does not extend to either side beyond the sides 78 of the bow handle 24, nor does it extend to obstruct the arrow rest 26. The handle 74 may be fastened to the pivot plate 52 by adjustment screws 80, to adjust 82 the handle 74 to fit over the hand grip 24 of different bows. The shape is most easily shown in the figures, and the exact shape for any bow 2 will be determined by the shape of the bow handle 24. This offset 84 of the handle 74 places the handle 74 vertically below the pivot bearings 54, and to the side of the bearing 54 towards the arrow rest 26. Depression 91 of the handle 74 therefore pivots the pivot plate 52 to an angle 90, away from parallel to the support plate 30, with the rear of the pivot plate 52 angled away from the line 38 of the arrow. The bias springs 66 otherwise resist such motion in the pivot plate 52.

On the outside surface 94 of the pivot plate 52 is formed a rod receiving receptacle 94. This is a closed hollow tube 96, blocked in front 98 to keep a retained rod 108 from going forward. This rod receiving tube 94 is fixed to the pivot plate 52, such as by welding, and receives and holds a support rod 108 or shaft. Preferably the rod 108 has, for a distance along a front end, a securing groove 100; a fastening screw 102 through the receptacle 94 engages this groove 100, and when tightened, holds the rod 108 in position within the hollow tube 96. By means of this tube 96 and screw 102 the exact length of the rod 108 may be adjusted, moving the rod 108 into or out of the hollow tube 96. It of course is apparent that many mechanical arrangements for fastening a rod 108 to the pivot plate 52 are possible, including simply welding the rod into a fixed position 104 on the plate.

The support rod 108 extends back 40 of the pivot plate 52, parallel to the line of the arrow 38 and laterally offset by the distance from the arrow rest 26 through the handle 24 to the surface of the pivot plate 52. At the end 110 of the rod 108 is a bow string receiving notch 112. This preferably is an angled smooth notch 112 in the rear end 110 of the rod 108, oriented towards the bow string 4. Since an arrow 10 must be nocked on the bow string 4, the rod 108 is offset vertically 114 from the arrow 10 by a distance. This is most easily accomplished by offsetting 114 the rod receiving receptacle 94 on the pivot plate 52 vertically by the appropriate amount.

Since the rod 108 must also clear the inner bow strings 12, the end 110 of the rod is best curved slightly to bring the rod notch 112 in line with the drawn bow string 4 at full draw.

In use an arrow 10 is nocked on the bow string 4, and the bow is drawn 14 in the normal manner by one hand 16 or two. The spring loading of the pivot plate 52 will bring the rear end 110 of the rod in line with the bow string 4, and a slight release movement after full draw brings the bow string 4 into the rod end notch 112; at this point, the rod 108 takes the full force of the drawn bow 2, holding it taunt. The arrow 10 cannot be released until bowstring 4 is pulled and then released to shoot. Once the bow string 4 is supported by the rod 108, the archer can relax muscle strain while aiming.

The archer is supporting the bow handle 24 in one hand, and the bow handle rests against the ball of the palm of that hand. When it is desired to shoot, the archer draws back slightly on the bow string 4, taking on the full pull in a smooth imperceptible action, without the motion of a full draw. The fingers of the archer's bow support hand rest over the pivot handle 74; this handle 74 can be gently squeezed against the bow handle 24, smoothly swinging the pivot plate 52, and the rod 108, out of the line of the bow string 4 without hitting the face, and away from the eyes of the face. The rod end 110 should swing four to six inches away from the face; a swing angle 90 of about 15 degrees is normally sufficient. Because the rod 108 and the pivot plate 52 pivot about bearings 54 which are spaced a distance apart along the vertical axis 58 of the bow 2, there is no vertical motion of the rod 108, and the rod's movement can be readily controlled by the speed of squeezing the handle 74. Thus the movement of the rod 108 is smooth, deliberate and slow, and will not spook game. Further, the action required of the archer is a smooth squeeze of the handle y the fingers; since the archer is supporting the bow handle against the palm of the same hand, against the force of the drawn bow, this squeeze is a natural motion. Some archers hold a bow with the fingers open, and some with the fingers curled in front of the bow handle; from either position, a squeeze motion is more natural than a push or other finger motion.

Figure 11:
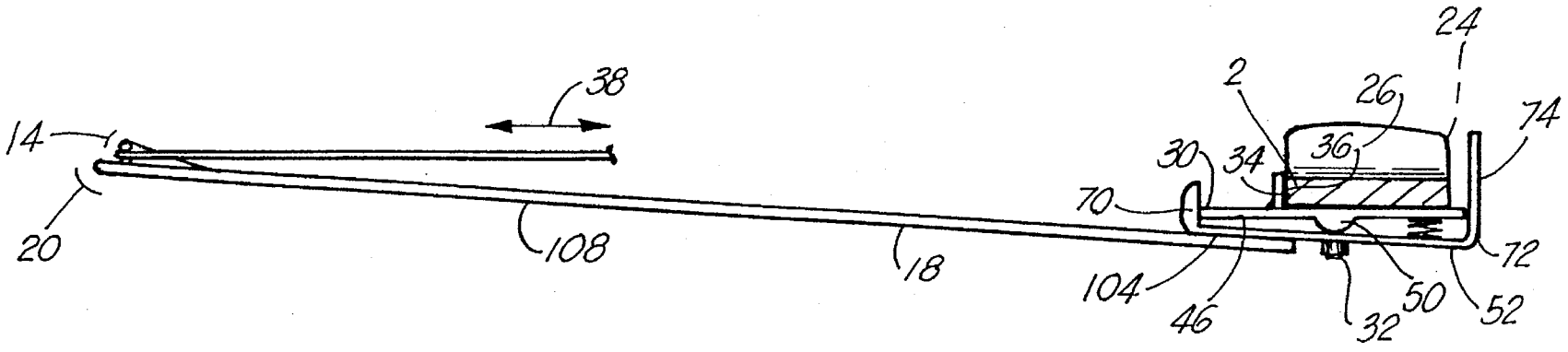
FIG. 11 is a section view of the invention when cocked.
Figure 10:
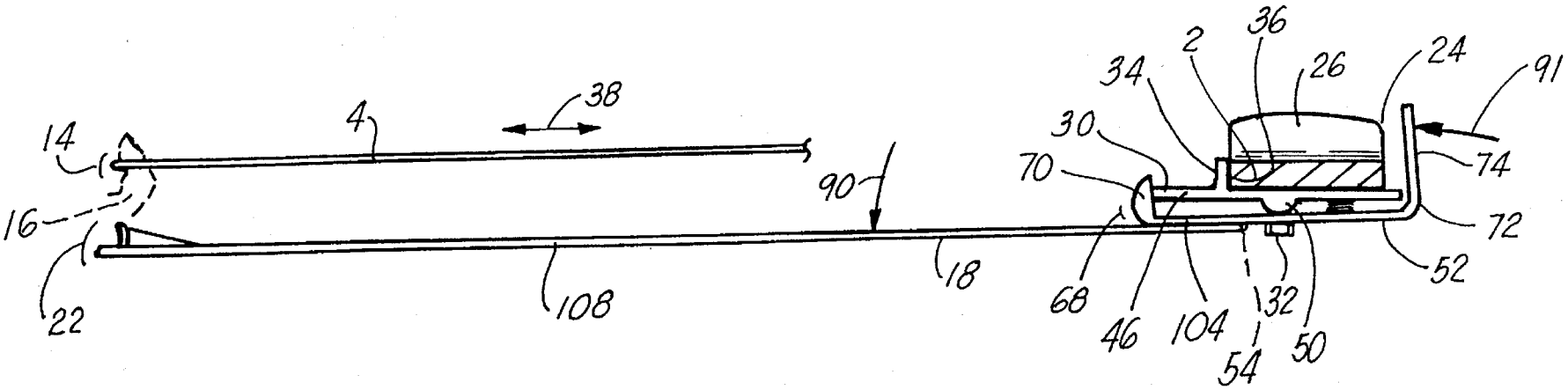
FIG. 10 is a section view of the invention when released.
Figure 12:
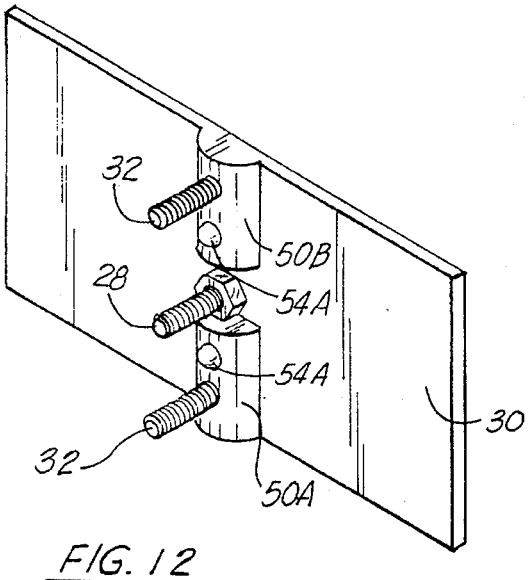
FIG. 12 is a view of the base support plate showing ball bearings.
Figure 13:
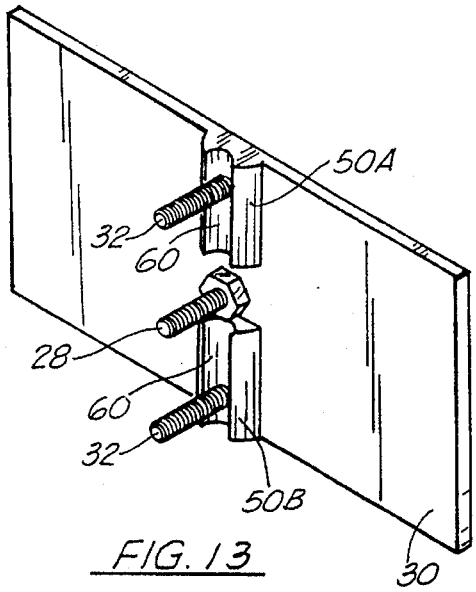
FIG. 13 is a view of the base support plate showing a second bearing embodiment.
Figure 15:
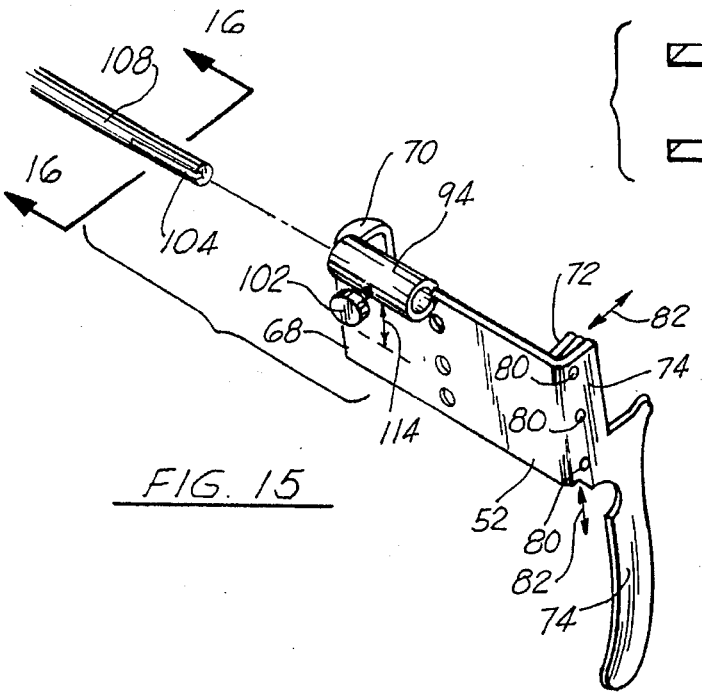
FIG. 15 is a detailed view of the rod and rod receiving recepticle.
Figure 14:
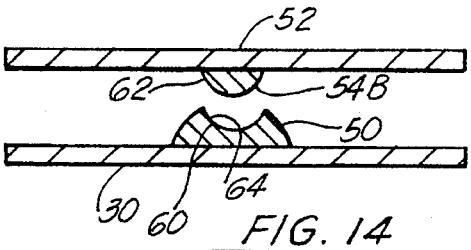
FIG. 14 is a side view of the second bearing embodiment.
Figure 16:
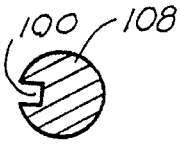
FIG. 16 is a cross section of the forward end of the rod.
Figure 17:
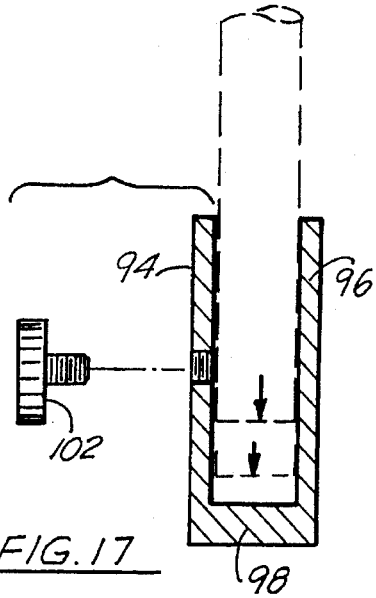
FIG. 17 is a cross section of the rod receiving recepticle.

Once the rod 108 is retracted, the arrow 10 is released, firing the bow 2. The design of the invention permits smooth, jerk free movement of the inventive bow support 18 from a cocked position (FIG. 11) to the arrow release position (FIG. 10). The strain on the archer is minimal. As a result, the archer's motions are smooth and controlled throughout; no perceptible motion, such as a full draw, and no unnatural vibration occurs to spook game. The archer, relieved of the strain of holding the bow in cock, is able to concentrate on aiming and release.

Further, since the invention is biased to catch the bow string upon full draw, a handicapped or disabled archer lacking strength to cock a bow, single handed, can cock the bow with both hands. The letoff of a fully cocked compound bow will reduce the force of the release pull on a fully drawn bow, so that such persons can release and fire the bow, even though they lack the strength to fully draw the bow.

I claim:

1. An apparatus for holding an archery bow in a cocked position comprising:

a base support fastened to a bow at a bow handle position, having a vertical pivoting ridge thereon;

a pivoting plate fastened to said base support, pivoting about said ridge;

a handle extending from said pivoting plate, in front of said bow handle;

a rod, having first and second ends, affixed to said pivoting plate at said front end, and extending to the rear of said bow;

means for biasing said pivoting plate to position said rod, parallel to the line of an arrow in said bow, said rod in said position parallel having said second end adjacent the position of a fully drawn bow string;

means for receiving and holding said bow string at said second end of said rod; said handle moving said rod away from said bow string against said means for biasing when depressed towards said bow handle.

2. The apparatus of claim 1, further comprising:

two vertically spaced bearings between said base support and said pivot plate;

said bearings supporting said pivot plate along said ridge for pivoting about said base support.

3. The apparatus of claim 2 further comprising:

said bearings being partly recessed into said base support;

said bearings being partly recessed into said pivot plate;

said bearings transferring sheer forces on said pivot plate into said base support.

4. The apparatus of claim 2, said bearings comprising:

two ball bearings, vertically spaced along said ridge, partly recessed into said ridge;

said bearings being partly recessed into said pivot plate.

5. The apparatus of claim 2, said bearings comprising:

a groove vertically inset along said ridge;

a line pivot bearing, affixed to said pivot plate, inset into said groove, said line pivot bearing extending vertically along said ridge.

6. The apparatus of claim 1 further comprising:

said means for biasing comprising at least one spring between said base support and said pivot plate.

7. The apparatus of claim 1 further comprising:

a closed end tube affixed to said pivot plate;

said rod being set into said tube:

a key groove along a front end of said rod; and a set screw within said tube for engaging said key groove in said rod to affix said rod at a position within said tube.

8. The apparatus of claim 1 further comprising:

a lip on said base support engaging and in contact with a rear surface of said bow handle;

means in said ridge for transferring sheer forces along said rod into said base support.

9. An apparatus for supporting an archery bow in a cocked position comprising:

a) a base support fastened to a bow at a bow handle position;

b) a pivoting plate fastened to said base support, pivoting about a ridge on said base support;

c) a moveable rod affixed to said pivoting plate and extending from a position adjacent said bow handle to a fully drawn bow string position;

d) a notch on said rod engaging said bow string when drawn into said fully drawn position;

e) means for biasing said pivoting plate to said moveable rod, substantially parallel to the line of an arrow in said bow, said moveable rod in said position parallel having a second end adjacent the position of a fully drawn bow string;

f) second means responsive to an archer's hand pull, for moving said moveable rod to a second position away from said bow string.

* * * * *